United States Patent [19]

Sawada et al.

[11] 4,197,821

[45] Apr. 15, 1980

[54] DEVICE FOR CONTROLLING VACUUM ADVANCING OF IGNITION TIMING

[75] Inventors: Daisaku Sawada; Takashi Shigematsu; Yuji Takeda, all of Susono, Japan

[73] Assignee: Toyota Jidosha Kogyo Kabushiki Kaisha, Japan

[21] Appl. No.: 827,707

[22] Filed: Aug. 25, 1977

[30] Foreign Application Priority Data

Aug. 31, 1976 [JP] Japan ..... 51-104610

[51] Int. Cl.[2] ..... F02P 5/10

[52] U.S. Cl. ..... 123/117 A; 123/117 R; 123/119 A

[58] Field of Search ..... 123/117 A, 117 R, 119 A

[56] References Cited

U.S. PATENT DOCUMENTS

| | | | |
|---|---|---|---|
| 3,476,094 | 11/1969 | Rucins et al. | 123/117 A |
| 3,699,936 | 10/1972 | Vartanian | 123/117 A |
| 3,915,136 | 10/1975 | Caldwell | 123/119 A |
| 3,948,232 | 4/1976 | Gould et al. | 123/117 A |
| 3,982,515 | 9/1976 | Bradshaw | 123/119 A |
| 3,990,419 | 11/1976 | Nohira et al. | 123/119 A |
| 3,994,269 | 11/1976 | Takaoka et al. | 123/117 A |
| 3,996,955 | 12/1976 | Kawabata | 123/117 A |
| 4,009,700 | 3/1977 | Engels et al. | 123/119 A |
| 4,022,169 | 5/1977 | Tanaka et al. | 123/117 A |
| 4,031,869 | 6/1977 | Onishi et al. | 123/117 A |
| 4,033,309 | 7/1977 | Hayashi et al. | 123/119 A |
| 4,040,401 | 8/1977 | Marsee | 123/117 A |
| 4,044,732 | 8/1977 | Inado et al. | 123/117 A |
| 4,050,423 | 9/1977 | Inadu et al. | 123/117 A |
| 4,077,373 | 3/1978 | Nallano et al. | 123/117 A |
| 4,095,568 | 6/1978 | Furukawa | 123/117 A |

*Primary Examiner*—Charles J. Myhre
*Assistant Examiner*—R. A. Nelli
*Attorney, Agent, or Firm*—Stevens, Davis, Miller & Mosher

[57] ABSTRACT

A device for controlling the vacuum advancing of ignition timing including a vacuum advancer, a diaphragm valve, a first vacuum port opened to an intake passage which is positioned so as to be immediately upstream of a throttle valve when it is fully closed and downstream of the throttle valve when it is slightly opened. A second vacuum port is located absolutely downstream of the throttle valve, wherein the diaphragm valve produces a fraction of the intake manifold vacuum when the throttle valve is fully closed while it communicates therethrough the intake manifold vacuum supplied from the second vacuum port when the throttle valve is opened so as to position the first vacuum port at the downstream thereof.

2 Claims, 2 Drawing Figures

DEVICE FOR CONTROLLING VACUUM ADVANCING OF IGNITION TIMING

BACKGROUND OF THE INVENTION

The present invention relates to a device for controlling ignition timing in internal combustion engines, and, more particularly, a device for controlling the vacuum advancing of ignition timing.

An internal combustion engine generally incorporates a vacuum advancer which advances ignition timing in accordance with the intensity of the intake vacuum in view of the fact that the combustion speed of fuel-air mixture in a cylinder chamber lowers as the intake vacuum increases. Such a vacuum advancer generally comprises a diaphragm means and an ignition timing advancing mechanism adapted to be actuated by the diaphragm means so that it advances ignition timing as the vacuum supplied to the diaphragm means increases. The diaphragm means is generally operated by a vacuum taken out from a port provided in an intake passage means such as a carburetor having a throttle valve, wherein the port is and located so as to be at the upstream side of the throttle valve when the throttle valve is fully closed and at the downstream side of the throttle valve when the throttle valve is slightly opened. By employing such a particular intake vaccum take-out port (advancer port), vacuum advancing of ignition timing is not effected when the engine is idling with the throttle valve being fully closed, while vacuum advancing of ignition timing is only actually effected when the throttle valve has been opened beyond a predetermined small opening, whereby a stabilized idling operation is ensured while a desirable vacuum advancing of ignition timing is effected in low load operating conditions. On the other hand, if the vacuum advancer is operated by an intake vacuum taken out from a port absolutely located at the downstream side of the throttle valve, an unduly large vacuum advancing of ignition timing is effected in idling operation thereby causing rough idling.

However, the fact that the aforementioned advancer port is generally employed for vacuum advancing does not mean that no advancing of ignition timing should be effected in idling operation. On the contrary, a moderate advancing of ignition timing in idling operation increases output power of the engine per unit amount of fuel thereby making it possible to reduce fuel consumption in idling. This is particularly effective in internal combustion engines for modern automobiles incorporating exhaust gas purification system in which the engine rotational speed in idling operation is made higher when compared with conventional engines.

SUMMARY OF THE INVENTION

It is therefore the primary object of the present invention to provide a device for controlling vacuum advance of ignition timing which effects a desirable advancing of ignition timing in operation under load as well as in idling operation of an internal combustion engine.

Another object of the present invention is to provide a device for producing a vacuum which is identical with an intake vacuum when a throttle valve is opened beyond a predetermined small opening and is a fraction of the intake vacuum when the throttle valve is fully closed.

Still another object of the present invention is to provide a device for generating a fractional vacuum of an intake vacuum by bleeding air into a vacuum system at a limited rate.

Other objects of the present invention will be in part obvious and will be in part pointed out in the following description.

BRIEF DESCRIPTION OF THE DRAWING

The present invention will become more fully understood from the detailed description given hereinbelow and the accompanying drawings which are given by way of illustration only and thus are not limitative of the present invention and wherein.

DESCRIPTION OF THE PREFERRED EMBODIMENT

Figure 1:
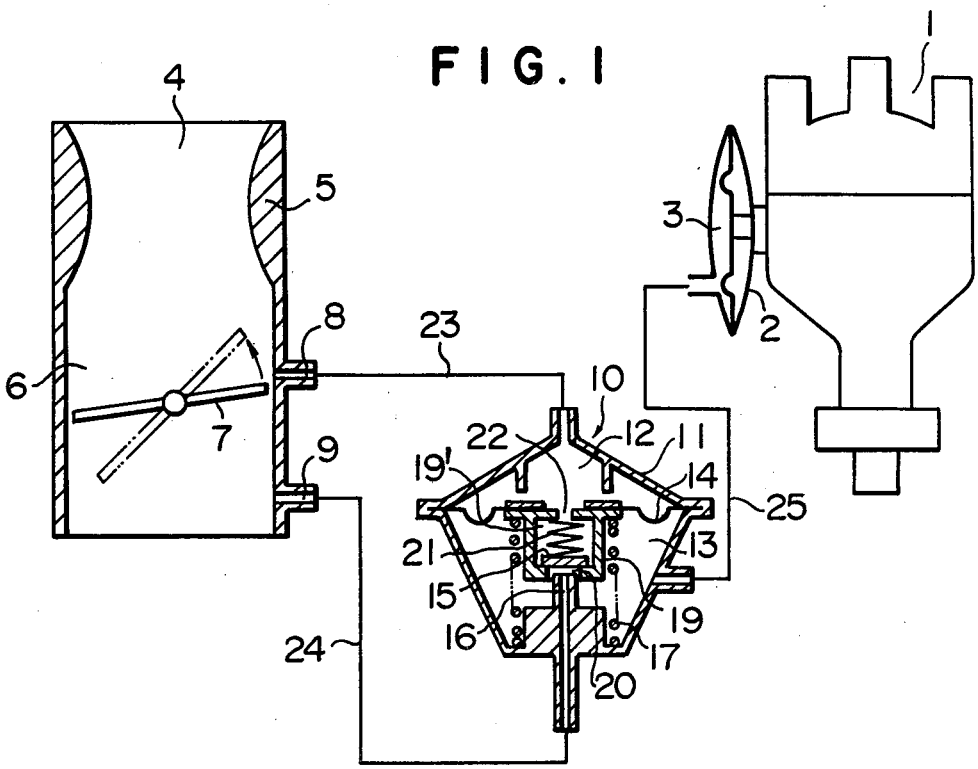
FIG. 1 is a diagrammatical view showing an embodiment of the device for controlling vacuum advancing of ignition timing of the present invention.

Referring to FIG. 1, 1 designates a distributor incorporating a vacuum advancer 2 adapted to be actuated by a diaphragm means having a diaphragm chamber 3. A vacuum advancer of this type is well known in the art and operates to advance ignition timing in accordance with the vacuum supplied to the diaphragm chamber 3.

On the other hand, a part of a carburetor is diagrammatically shown as designated by 4 and having a venturi portion 5, an intake passage 6 and a throttle valve 7. The carburetor is provided with a first intake vacuum port 8 which is positioned to open to the intake passage 6 at the upstream side of the throttle valve 7 when it is fully closed and to be open to the downstream side of the throttle valve when it is slightly opened. This is a well-known advancer port. A second intake vacuum port 9 is also provided to open into the intake passage 6 at a position located absolutely to the downstream side of the throttle valve 7.

10 designates a diaphragm valve which forms an essential part of the device for controlling the vacuum advancing of ignition timing of the present invention. The diaphragm valve comprises a housing 11 and a diaphragm 14 which defines first and second diaphragm chambers 12 and 13 in said housing. In the diaphragm chamber 13 is provided a valve structure including a mutually confronting valve element 15 and a valve port 16. The valve element 15 is supported by the diaphragm 14 by way of a sleeve member 19 having an opening 20 through which a tubular element defining the valve port 16 is movable relative to the valve element. The diaphragm 14 is biased upward in the figure by a compression coil spring 17 while the valve element 15 received in a chamber 19' defined by the sleeve element 19 is biased downward in the figure by a compression coil spring 21. An air bleed port 22 is provided at a central portion of the diaphragm 14 and the sleeve element 19 so as to communicate the first diaphragm chamber 12 and the internal chamber 19' of the sleeve element 19 with each other. The first diaphragm chamber 12 is connected with the first intake vacuum port 8 by a passage means 23. The valve port 16 is connected with the second intake vacuum port 9 by a passage means 24. Finally, the second diaphragm chamber 13 is connected with the diaphragm chamber 3 of the vacuum advancer by a passage means 25.

In the diaphragm valve 10 shown in FIG. 1, various structural members are so designed that when a certain determined value of vacuum difference exists between the first and second diaphragm chambers 12 and 13, the valve port 16 is just closed by the valve element 15 while the opening 20 is maintained as closed by the valve element 15, whereas if the vacuum difference between the two diaphragm chambers exceeds said determined value so as to bias the diaphragm 14 through a greater extent downward in the figure, the opening 20 is opened by the valve element 15 being lifted upward relative to the sleeve element 19 while the valve element 15 abuts against the valve port 16 thereby maintaining the valve port 16 in the closed condition, whereas on the other hand if the vacuum difference lowers below the aforementioned determined value, the valve element 15 is lifted up from the valve port 16 thereby opening the valve port 16 while the valve element 15 is maintained in contact with the sleeve element thereby maintaining the opening 20 in closed condition.

The device shown in FIG. 1 operates as follows. Let us assume that an engine incorporating such a device is started up with the throttle valve 7 being positioned in the full closed position as shown by solid lines in FIG. 1. The port 8 is supplied with atmospheric pressure so that the first diaphragm chamber 12 is at atmospheric pressure. On the other hand, as the engine rotates, the port 9 is supplied with a gradually increasing vacuum which is transmitted to the second diaphragm chamber 13 through the open valve port 16. If the vacuum difference between the first and second diaphragm chambers 12 and 13 reaches the aforementioned determined value, the port 16 is closed by the valve element 15 and, thereafter, the vacuum level in the diaphragm chamber 13 is maintained at a constant level which is designed to be a desirable fraction of the intake vacuum in idling operation.

When the throttle valve 7 is opened beyond a position to transverse the port 8 so as to operate the engine in an under-load condition, the ports 8 and 9 are supplied with substantially the same intake manifold vacuum, whereby the vacuum difference existing between the diaphragm chambers 12 and 13 lowers under the aforementioned determined value. Therefore, the diaphragm 14 is now shifted upward in the figure thereby opening the valve port 16 to the second diaphragm chamber 13 without any substantial restriction. Therefore, when the engine is operating in a loaded condition with the throttle valve 7 being opened to a position as shown by phantom lines in FIG. 1, the diaphragm chamber 3 of the vacuum advancer 2 is supplied with the total intake manifold vacuum and operates the vacuum advancer in the usual manner so as to advance the ignition timing in accordance with the intensity of manifold vacuum.

When the throttle valve 7 is again closed to the full closed position, the port 8 is again supplied with atmospheric pressure and, accordingly, the first diaphragm chamber 12 is brought to atmospheric pressure. On the other hand, the port 9 is now supplied with a relatively high intensity of vacuum which is transmitted to the second diaphragm chamber 13 and causes a relatively large vacuum difference between the diaphragm chambers 12 and 13 which is of course higher than the aforementioned determined value. Therefore, the diaphragm 14 is biased downward in the figure so far that the valve element 15 which abuts against the valve port 16 to close it is lifted from the sleeve element 19 so as to open the opening 20. Therefore, air flows from the diaphragm chamber 12 into the diaphragm chamber 13 through the air bleed port 22 and the opening 20 thereby gradually reducing the vacuum level existing in the second diaphragm chamber 13. When the vacuum difference existing between the two diaphragm chambers 12 and 13 lowers down to the aforementioned determined value, the valve element 15 is again seated against the sleeve element 19 and closes the opening 20 so that thereafter the vacuum level in the second diaphragm chamber 13 is maintained at a constant level which is a desirable fraction of the intake manifold vacuum in idling operation.

Figure 2:
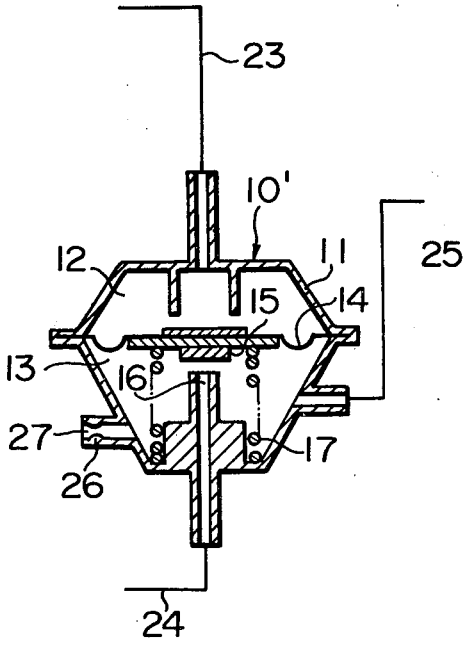
FIG. 2 is a view corresponding to a part of FIG. 1, showing a modification of a diaphragm valve.

FIG. 2 shows a modification of the diaphragm valve 10 incorporated in the device shown in FIG. 1. The diaphragm valve 10' shown in FIG. 2 also comprises a housing 11, first and second diaphragm chambers 12 and 13, a diaphragm 14, a valve element 15, a valve port 16 and a compression coil spring 17 similar to those in the diaphragm valve 10 shown in FIG. 1. Similarly, the first diaphragm chamber 12 is connected to the port 8 by the passage means 23, while the valve port 16 is connected to the port 9 by the passage means 24. Similarly, the second diaphragm chamber 13 is connected to the diaphragm chamber 3 of the vacuum advancer 2 by passage means 25. However, in this modified diaphragm valve 10', an air bleed port 27 having a throttling means 26 is provided to directly open toward the second diaphragm chamber 13 from the atmosphere. On the other hand, the valve element 15 is now directly supported by the diaphragm 14. In this diaphragm valve structure, the various structural elements are also so designed that when a certain determined value of vacuum difference exists between the first and second diaphragm chambers 12 and 13, the valve element 15 just abuts against the end of the tubular element providing the valve port 16 so as to close the valve port.

The device for controlling vacuum advancing of ignition timing incorporating the diaphragm valve 10' in place of the diaphragm valve 10 operates in a similar manner to the device shown in FIG. 1. Let us assume again that the engine is started up with the throttle valve 7 being positioned at its fully closed position as shown by solid lines in FIG. 1. As the engine rotates, a gradually increasing vacuum is supplied to the diaphragm chamber 13, while the diaphragm chamber 12 is maintained at atmospheric pressure. When the vacuum difference between the two diaphragm chambers 12 and 13 reaches the aforementioned determined value, the valve element 15 supported by the downward biased diaphragm 14 closes the valve port 16, thereby interrupting further evacuation of air from the diaphragm chamber 13. In this condition, a certain moderate vacuum advancing of ignition timing by a fraction of the total intake manifold vacuum is effected. However, due to an air inflow into the diaphragm chamber 13 at a very low rate caused by the provision of the air bleed port 27, the vacuum level in the diaphragm chamber 13 is gradually reduced until at last the vacuum difference between the diaphragm chambers 12 and 13 lowers below the aforementioned determined value so that the valve element 15 opens the valve port 16. However, if the valve port 16 is opened, vacuum is again introduced into the diaphragm chamber 13, or, stating accurately, air is again evacuated from the diaphragm chamber 13 through the port 16 and the passage means 24. Therefore, the level of the vacuum in the chamber 13 is again increased so far that the valve 15 is again biased toward the valve element port 16 and closes the valve port. In this fluctuating manner, the vacuum level in the diaphragm chambers 13 and 3 is maintained at the aforementioned desirable fraction of the total intake manifold vacuum in idling operation of the engine.

When the throttle valve 7 is opened as shown by phantom lines in FIG 1 to operate the engine in an under-load condition, the ports 8 and 9 are both supplied with substantially the same manifold vacuum and, therefore, the vaccum difference between the diaphragm chambers 12 and 13 disappears. Consequently, the diaphragm 14 is biased upward by the spring 17 together with the valve element 15 which definitely opens the valve port 16. In this condition, therefore, the diaphragm chamber 3 of the vacuum advancer is supplied with the total intake manifold vacuum and operates the vacuum advancer in the usual manner so as to advance the ignition timing in accordance with the intensity of intake manifold vacuum.

When the throttle valve 7 is again closed to its full closed position, the port 8 is again supplied with atmospheric pressure. In this condition, it will be obvious that the device operates in the same manner as in the initial idling condition as explained above.

Although the invention has been shown and described with respect to some preferred embodiments thereof, it should be understood by those skilled in the art that various changes and omissions of the form and detail thereof may be made therein without departing from the scope of the invention.

We claim:

1. A device for controlling the vacuum advance of ignition timing in an internal combustion engine, comprising a vacuum advancer having a diaphragm chamber connected to advance the ignition timing in accordance with the vacuum supplied to said diaphragm chamber, an intake passage means having a throttle valve, a first intake vacuum port in said intake passage means located so as to be at the upstream side of said throttle valve when said throttle valve is fully closed housing defining first and second diaphragm chambers, a spring biasing said diaphragm toward said first diaphragm chamber, a valve element operated by said diaphragm, a valve port normally open to said second diaphragm chamber and positioned so as to be closed by said valve element when said diaphragm is biased for a predetermined amount from its normal position toward said second diaphragm chamber by a predetermined difference between the pressures in said first and second diaphragm chambers against the biasing force exerted by said spring, said predetermined pressure difference being a fraction of the intake vaccum in idling operation of the engine, and an air bleed port connecting said first and second diaphragm chambers which is normally closed by said valve element and is opened when said diaphragm is biased beyond said predetermined amount from its normal position toward said second diaphragm chamber due to increase of the pressure difference between said first and second diaphragm chambers beyond said predetermined pressure against the biasing force exerted by said spring, the air bleed into said second diaphragm chamber through said air bleed port reducing the pressure difference between said first and second diaphragm chambers, a first passage means connecting said first diaphragm chamber with said first intake vacuum port, a second passage means connecting said valve port with said second intake vacuum port, and a third passage means connecting said second diaphragm chamber with said diaphragm chamber in said vacuum advancer.

2. The device of claim 1, wherein said diaphragm valve further comprises a sleeve element mounted to said diaphragm and having said bleed port, said valve element being supported by said diaphragm by way of said sleeve element, a tubular portion which provides said valve port, said tubular portion passing through said bleed port formed in said sleeve element to selectively engage said valve element, an air bleed opening provided in said diaphragm and communicating an in-